United States Patent [19]

McLaughlin

[11] 4,389,735

[45] Jun. 28, 1983

[54] CONVERTIBLE ARTICLE

[76] Inventor: Rita E. McLaughlin, P.O. Box 1662, Boston, Mass. 02105

[21] Appl. No.: 315,026

[22] Filed: Oct. 26, 1981

[51] Int. Cl.[3] ..... A41B 11/00

[52] U.S. Cl. ..... 2/94

[58] Field of Search ..... 2/85, 86, 87, 94; 224/5

[56] References Cited

U.S. PATENT DOCUMENTS 2,248,455 7/1941 Freund ..... 2/94
3,085,254 4/1963 Cutler ..... 2/87

FOREIGN PATENT DOCUMENTS 239296 10/1911 Fed. Rep. of Germany ..... 2/85
815934 10/1951 Fed. Rep. of Germany ..... 2/85

*Primary Examiner*—Doris L. Troutman
*Attorney, Agent, or Firm*—Schiller & Pandiscio

[57] ABSTRACT

A combined coat and backpack is described. The pack is formed on the exterior portion of the coat and includes a first compartment for containing objects to be carried in the pack. The pack also includes means secured to the article and cooperative with the interior portion of said part of the coat so as to form a second compartment adjacent the first compartment of the pack for receiving the coat in a substantially folded manner. Shoulder straps can be used whether the pack is worn alone or with the coat. The combined coat and backpack are adapted to be worn in either (1) a first mode wherein the coat is concealed in the second compartment, or (2) a second mode wherein the coat and pack are worn by the individual with the pack disposed on the outside of the coat.

8 Claims, 10 Drawing Figures

CONVERTIBLE ARTICLE

The present invention relates generally to garment articles which can be worn by an individual in either one of two modes, and more particularly, to a combined backpack and coat constructed so that the backpack can be worn alone or with the coat.

Garments which can be folded into carrying bags are known. See, for example, U.S. Pat. Nos. 1,197,236, 1,643,440, 1,797,208, 2,058,474, 2,072,030, 2,146,343, 2,375,655, 2,462,269 and 3,085,254. Some garment articles combine a cape with back pockets, such as shown in German Pat. No. 366175 issued Dec. 30, 1922, a coat folded into a carrying case such as shown in German Pat. No. 639172 issued Nov. 30, 1936, and a coat with a backpack as shown in French Pat. No. 419935 issued Nov. 9, 1910.

In one embodiment described in the latter French patent, the backpack is adapted to retain objects the individual wishes to carry on his or her back. When it is desirable to wear the pack without the coat, the latter is adapted to be folded up and secured by straps to the outside portion of the pack remote from the wearer. The flap covering the open top of the pack is secured to the lower edge of the inside portion of the pack against the individual wearer's back presumably because the coat is secured to the remote portion of the pack. Thus, opening and closing the top flap will not depend upon whether the coat is folded and secured to the pack. When it is desirable to wear the coat, the coat can easily be unfolded. This particular design provides that the entire pack is disposed inside the coat when the coat is worn, presumably to protect the pack from the elements. The pack is carried in the same manner, whether it is worn with the coat or alone.

This construction is undesirable because the cover flap of the pack is secured to the lower edge of the inside portion of the pack. This makes it difficult, if not impossible, for someone to have access to the contents of the pack, unless the pack is completely removed from one's shoulders. This problem is further exacerbated when the pack is worn under the coat, since the coat also must be removed.

It is an object of the present invention to provide a combined, convertible coat and backpack which includes many of the advantages of the prior art, while reducing or overcoming the above noted problems. Another object of the present invention is to provide an improved backpack combined with a coat so that the coat can be worn with the backpack, or folded into a separate compartment of the backpack.

And another object of the present invention is to provide an improved combined backpack and coat which is constructed to provide easy access to the interior of the backpack whether worn alone or with the coat.

These and other objects are achieved by an improved convertible article comprising, in combination, a coat and a backpack. The pack is formed on the exterior portion of a part (preferably the backside) of the coat and includes a first compartment for containing one or more objects to be carried in the backpack. The pack also includes means secured to the article and cooperative with respect to the interior portion of said part of the coat so as to form a second compartment adjacent the first compartment of the pack for receiving the coat in a substantially folded manner. Shoulder straps are preferably secured to the article so that they can extend around and be supported by the shoulders of the individual when the pack is carried on the back of the individual, regardless of whether the coat is worn or not. The preferred form of the combined coat and backpack is adapted to be worn in either (1) a first mode wherein the coat is concealed in the second compartment, the straps extend around and are supported by the shoulders of the individual and the pack is carried by the individual, or (2) a second mode wherein the coat is worn by the individual, the pack is disposed outside the coat, the straps extend outside the coat and are supported by the shoulders of the individual, and the pack is carried on the back of the individual.

Other objects of the invention will in part be obvious and will in part appear hereinafter. The invention accordingly comprises the product possessing the features, properties and relation of components which are exemplified in the following detailed disclosure and the scope of the application of which will be indicated in the claims.

For a fuller understanding of the nature and objects of the present invention, reference should be had to the following detailed description taken in connection with the accompanying drawings wherein.

The same numerals are used throughout the drawings to indicate like or identical parts.

Figure 4:
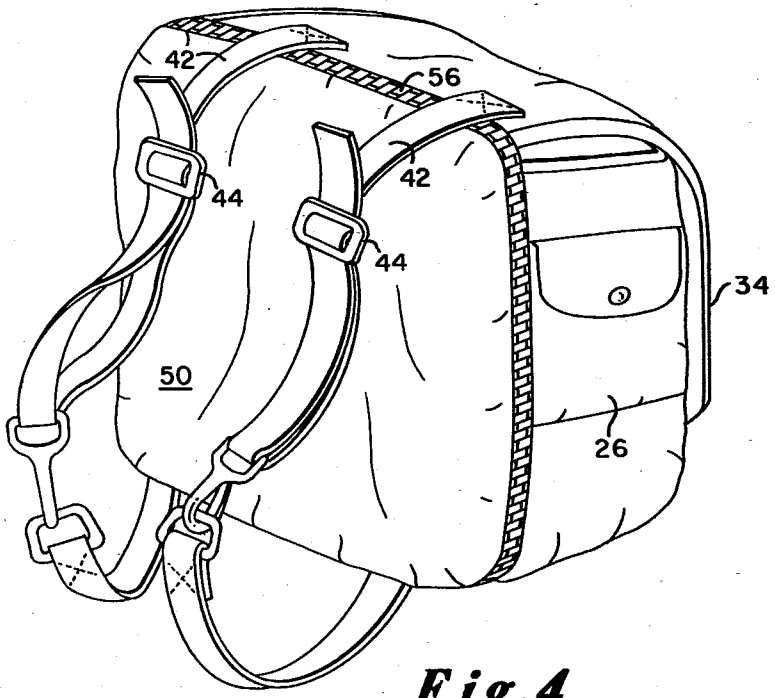
FIG. 4 shows a rear perspective view of the backpack assembled so as to be worn without the coat.

Referring to the drawings the article of the present invention includes the combination of a coat 10 and backpack 12. The coat 10 and packpack 12 are preferably made of a water resistant or repellant material, such as a nylon or rubberized material, so that it can be worn in inclement weather. Further, various light reflective materials can be used to make all, or part of the structure to enhance its visibility. Preferably, as shown in FIGS. 1, 2, and 7A–7C, the coat includes the sleeves 14 and hood 16 and has an open front 18.

Figure 3:
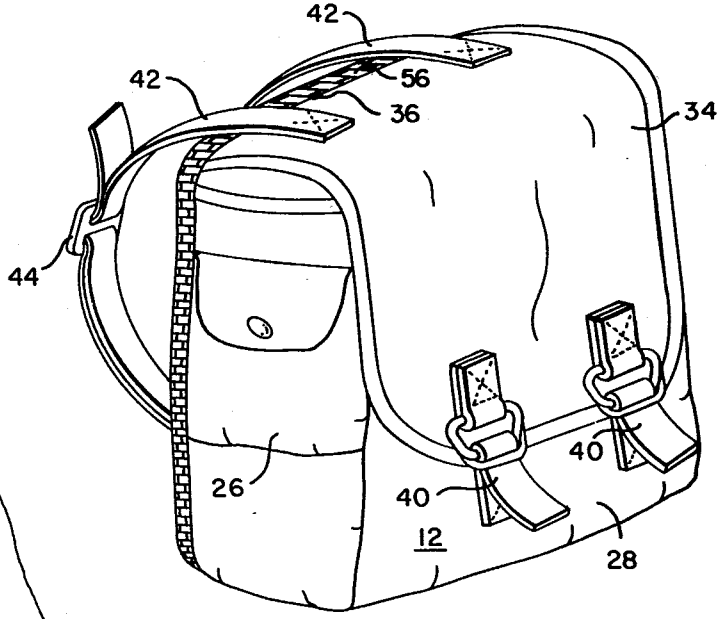
FIG. 3 shows a front perspective view of the backpack assembled so as to be worn without the coat.
Figure 5:
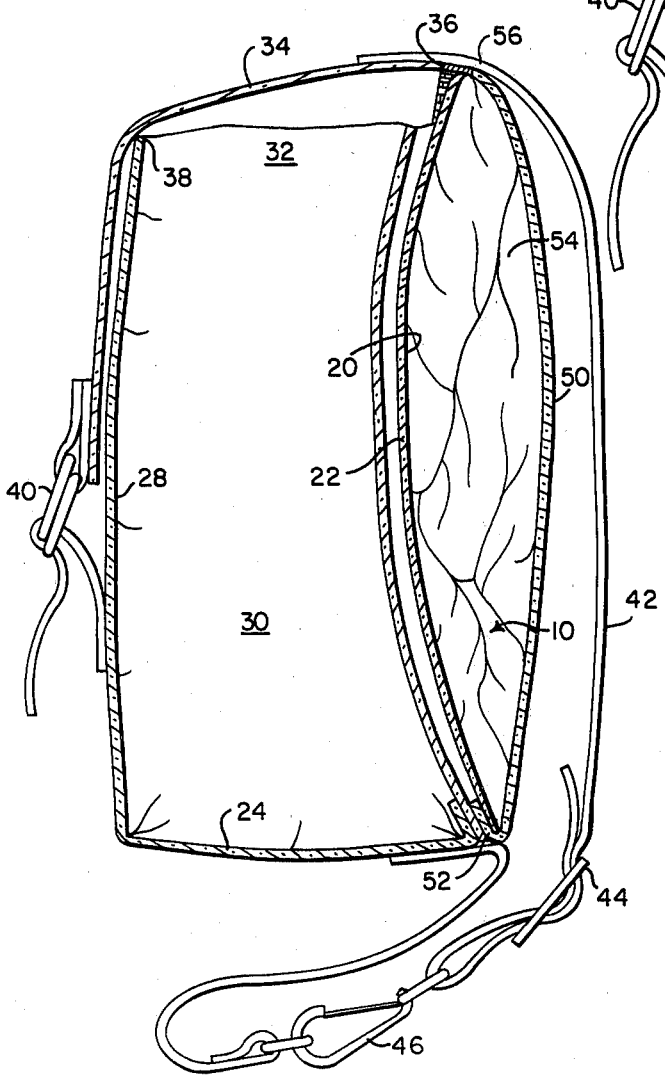
FIG. 5 shows a vertical cross-sectional view of the backpack shown in FIGS. 3 and 4 with the coat concealed in its storage compartment.
Figure 6:
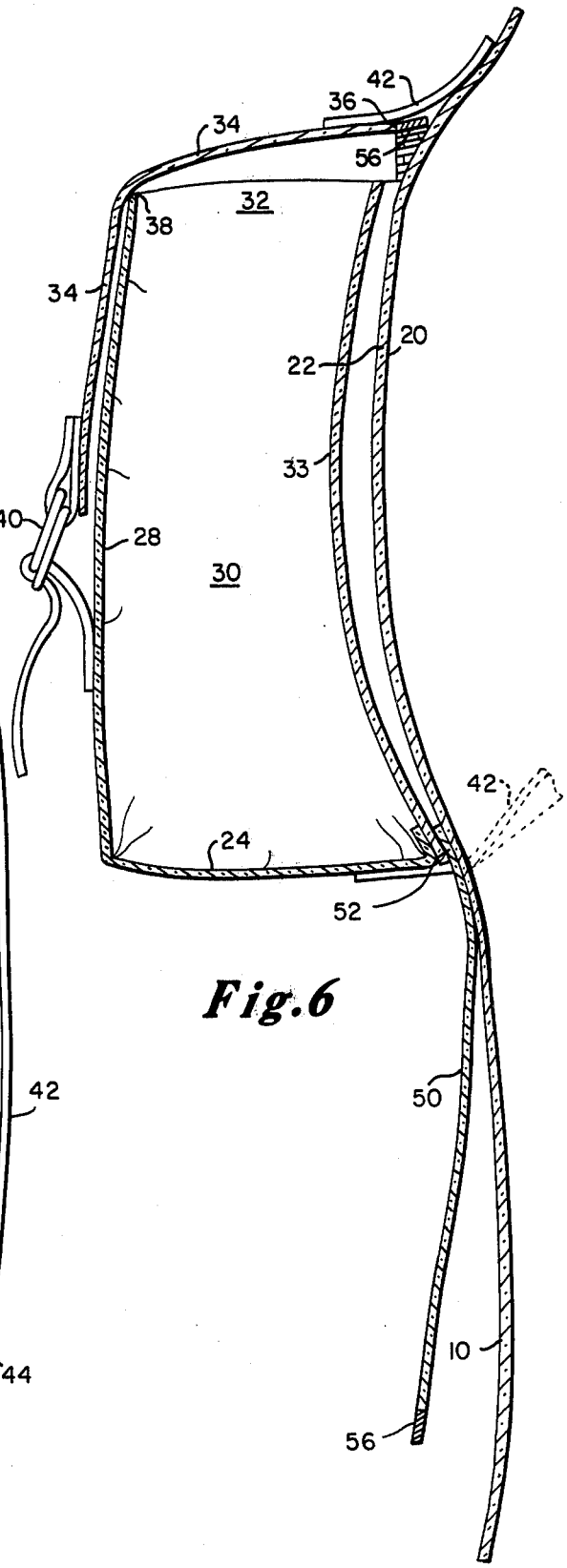
FIG. 6 shows a vertical cross-sectional view of the backpack with the coat being worn by the individual.

As best shown in FIGS. 5 and 6 the backpack 12 is secured preferably to the exterior portion of the back part 20 of the coat. The backpack 12 preferably includes a back section 22 secured to the exterior back part 20 of the coat, a bottom section 24 and opposite side sections 26 (shown in FIGS. 3 and 4) each respectively extending from the bottom and side edges of the back section 22, and a front section 28 secured to the bottom and side sections. Back section 22, bottom section 24, side sections 26 and front section 28 form the compartment 30 for holding objects to be carried in the pack. Compartment 30 has an open top 32 for receiving the objects into the compartment.

Means are also preferaby provided for closing the open top 32. Preferably, the means includes a flap 34 secured along one edge 36 to the top of back part 20 of the coat 10 and extending over the open top 32, over the top edge 38 of front section 28. Suitable fastening means such as strap and buckle arrangements 40 are provided for securing the flap 34 to the front section 28 of the pack so that when secured the open top 32 is completely covered.

Figure 2:
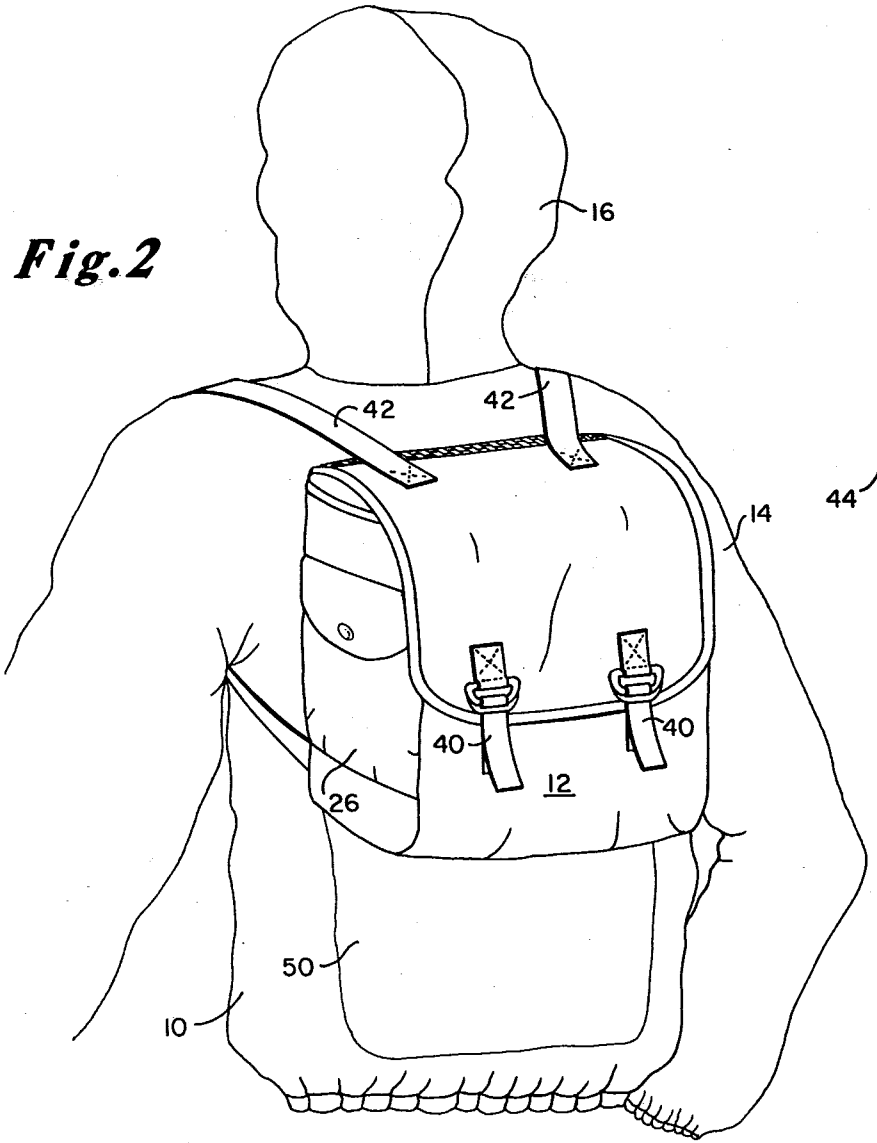
FIG. 2 illustrates the preferred embodiment of the present invention worn by an individual in the second mentioned mode wherein both the coat and pack are worn.

A pair of adjustable shoulder straps 42 including buckles 44 and snap fasteners 46 are each secured to the top and bottom of the pack 12 so as to extend over and be supported by the individual's shoulders whether the coat is worn or not. As shown in FIG. 2, the straps 42 extend over the shoulders exterior of the coat when the coat is worn by the individual.

The article further includes means for defining a second compartment adjacent the first compartment for concealing the coat when it is desirable not to wear it. More particularly, the article includes a second flap 50 secured to the article along one of its edges. The flap preferably is secured to the edge 52 formed by the bottom and back sections of the backpack 12 so that the flap 50 hangs down, as shown best in FIGS. 2 and 6, when the coat is worn with the pack. In order to conceal the coat when it is desirable to wear only the backpack, the preferred method of folding the coat into a second compartment is shown in FIGS. 7A through 7D. The second compartment 54 is preferably formed by and between the back portion 20 of the coat and the flap 50 as best shown in FIG. 5.

Figure 1:
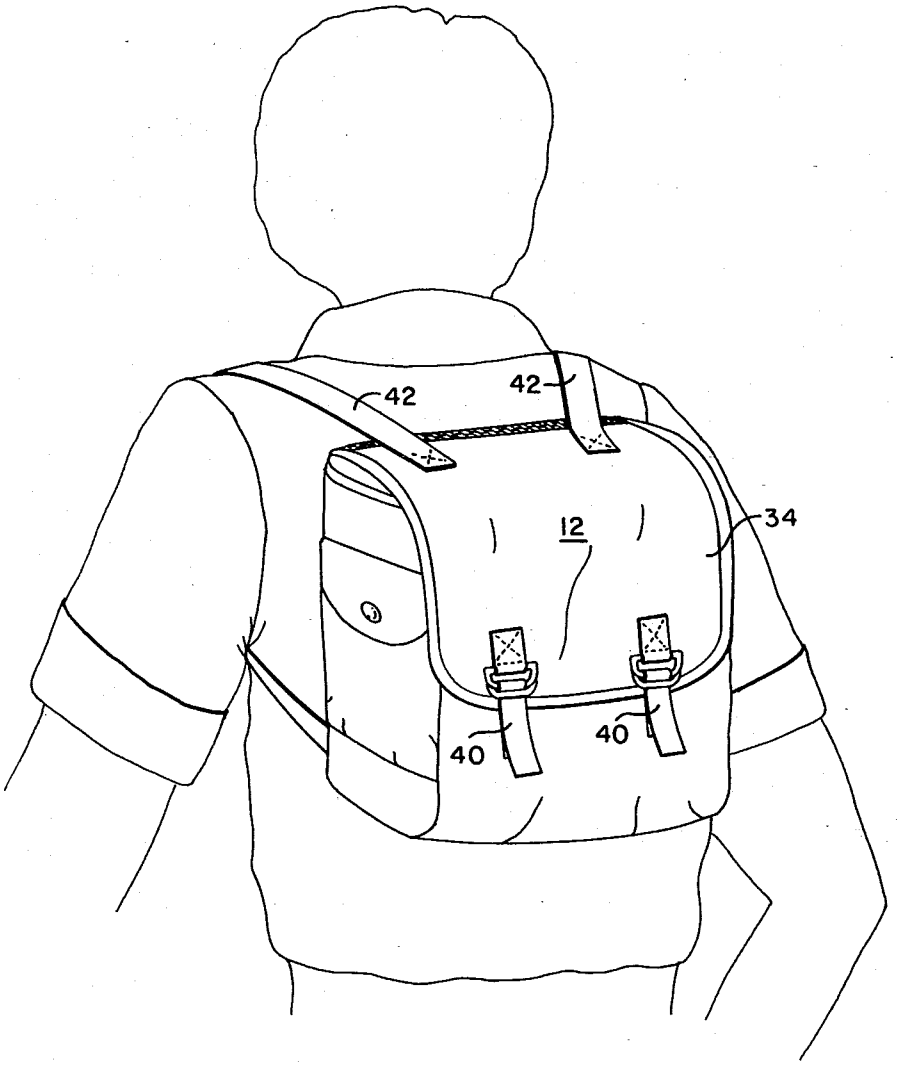
FIG. 1 illustrates the preferred embodiment of the present invention worn by an individual in the first mentioned mode wherein only the backpack is worn.
Figure 7A:
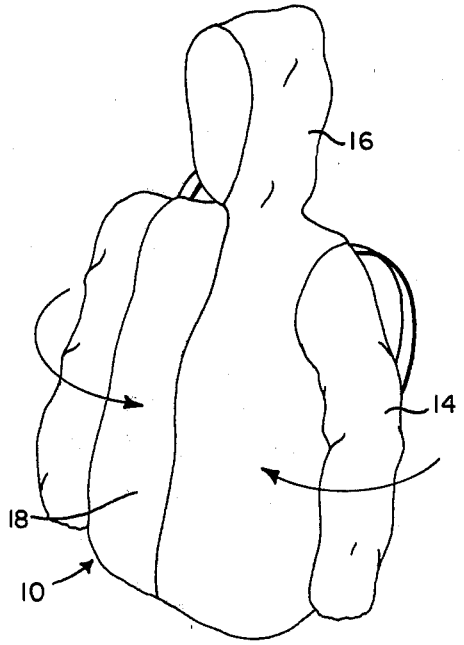
FIGS. 7A–7D show, sequentially a technique for folding the coat into its storage compartment.
Figure 7B:
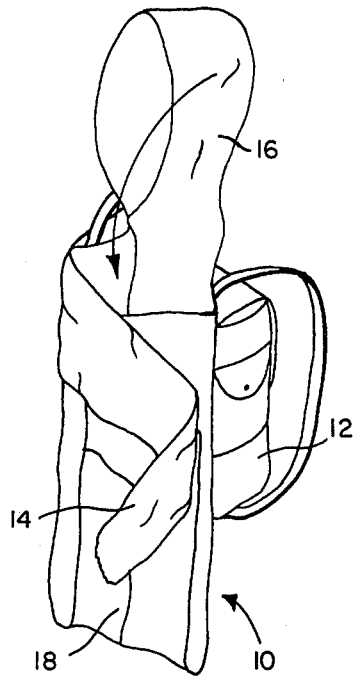
Figure 7C:
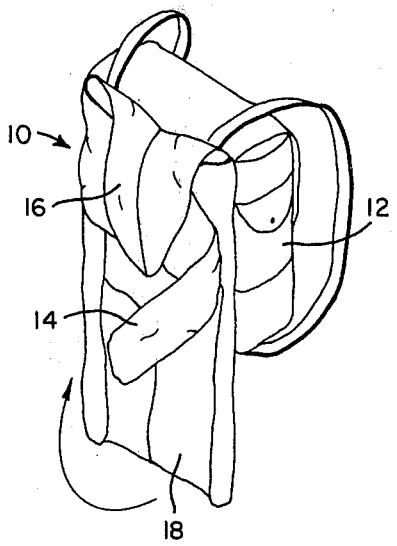
Figure 7D:
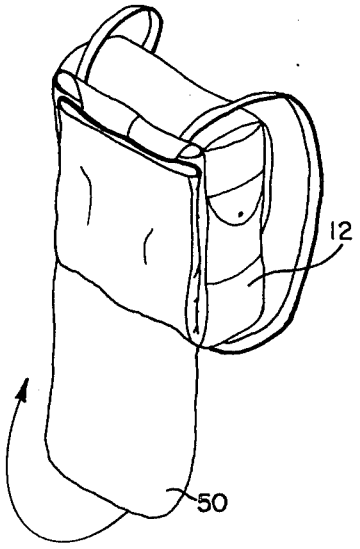

More particularly, in FIG. 7A, the sleeves 14 of the coat are folded across the front 16 of the coat as shown in FIG. 7B. The hood 16 is then folded down over the front as shown in FIG. 7C. The bottom of the coat is then folded over the front, covering hood 16 as illustrated in FIG. 7D. The flap 50 can then be folded over the folded coat, registered with the back part 20 of the coat and the side and top edges secured, for example with zipper 56, to the corresponding adjacent edges (including the edge 36 as well as the edges 58 formed by the attachment of the side sections 26 with the back part 20 of the coat) of the pack so as to secure the folded coat in compartment 54 formed by and between the interior portion of the back part 20 of the coat and the flap 50. The pack can then be worn as shown in FIG. 1.

Should it be desirable to wear the coat, the zipper 56 is unzipped, and the flap 50 unfolded to the position shown in FIG. 7D. The coat can then be unfolded in the sequence from FIGS. 7C to 7B to 7A. The coat can then be worn with the pack as shown in FIG. 2.

In both modes, easy access to compartment 30 is provided through open top 32 by unfastening and lifting flap 34 even when the pack is being worn. The straps 42 and 48 provide good support and can easily be removed before removing the coat since they are constructed to be worn outside the coat, when the latter is being worn.

Since certain changes may be made in the above product without departing from the scope of the invention herein involved, it is intended that all matter contained in the above description or shown in the accompanying drawing shall be interpreted in an illustrative and not in a limiting sense.

What is claimed is:

1. A convertible article adapted to be worn by an individual in one of a first and second modes, said article comprising, in combination:

a coat;

a storage pack formed to an exterior portion of a part of said coat, said storage pack including a first compartment for containing one or more objects to be carried in said storage pack;

shoulder straps secured to said storage pack for extending around the shoulders of the individual so that the storage pack is supported, at least in part, by said straps when said article is worn by said individual in either of said first or second modes; and means cooperative with the interior portion of said part of said coat for defining a second compartment for receiving the coat in a concealed manner;

wherein in said first mode said coat and said storage pack are worn by and the shoulder straps extend on the exterior side of said coat around the shoulders of the individual, and in said second mode said storage pack is worn by and the shoulder straps extend around the shoulders of the individual with said coat disposed in and concealed by said second compartment.

2. An article according to claim 1, wherein said storage pack is secured to the backside part of said coat.

3. An article according to claim 2, wherein said storage pack includes an open top for said first compartment, and means for closing said open top.

4. An article according to claim 2, wherein said means for defining said second compartment includes a flap secured to said article and adapted to be folded with respect to the interior portion of said part of said coat so as to define said second compartment.

5. An article according to claim 4, wherein said flap is secured along one edge to said coat adjacent said exterior portion so that said coat can be folded with respect to said interior portion, said flap disposed over said coat substantially in registration with the interior portion and the edges of said flap secured to said article so as to conceal said coat between said interior portion of said part of coat when said article is worn in said second mode.

6. An article according to claim 5, wherein the edges of said flap are secured along the edges of said storage pack where said storage pack is secured to said coat.

7. An article according to claim 1, wherein said coat and storage pack are made of water resistent material.

8. An article adapted to be worn by an individual in one of a first and second modes, said article comprising, in combination:

a coat including a backside part; and a storage pack formed on an exterior portion of said backside of said coat, said storage pack including an open top and forming a first compartment for containing one or more objects to be carried in said storage pack, and means secured to said article and cooperative with respect to the interior portion of the backside of said coat so as to form a second compartment adjacent the first compartment for receiving the coat in a concealed manner;

wherein (a) said coat is concealed in said second compartment and said storage pack is carried on the back of the individual when said article is worn in the first mode, and (b) the storage pack is disposed outside said coat and the pack is carried on the back of the individual when said article is worn in the second mode.

* * * * *